US005570850A

United States Patent [19]

Kay

[11] Patent Number: 5,570,850

[45] Date of Patent: Nov. 5, 1996

[54] CRUSHER

[76] Inventor: Roger T. Kay, 971 Cobbitty Rd., Oran Park, NSW, Australia, 2567

[21] Appl. No.: 338,614

[22] PCT Filed: May 25, 1993

[86] PCT No.: PCT/AU93/00239

§ 371 Date: Apr. 12, 1995

§ 102(e) Date: Apr. 12, 1995

[87] PCT Pub. No.: WO93/24235

PCT Pub. Date: Dec. 9, 1993

[30] Foreign Application Priority Data

May 25, 1992 [AU] Australia ..... PL2596

[51] Int. Cl.[6] ..... B02C 2/00; B02C 2/04

[52] U.S. Cl. ..... 241/207; 241/214; 241/215

[58] Field of Search ..... 241/207, 208, 241/214, 215

[56] References Cited

FOREIGN PATENT DOCUMENTS

| | | | |
|---|---|---|---|
| 67577 | 9/1975 | Australia . | |
| 0200665 | 5/1986 | European Pat. Off. . | |
| 1044327 | 9/1983 | U.S.S.R. | 241/214 |
| 1457990 | 2/1989 | U.S.S.R. | 241/214 |
| 1592033 | 9/1990 | U.S.S.R. | 241/207 |

*Primary Examiner*—John M. Husar

*Attorney, Agent, or Firm*—Jacobson, Price, Holman & Stern, PLLC

[57] ABSTRACT

The invention is a crusher having a fixed crusher member and a vertically reciprocating crusher member. Reciprocation of the crusher member is achieved by a pivoting arm located beneath the crusher member which is preferably driven by a toggle mechanism located to one side of the crusher.

9 Claims, 1 Drawing Sheet

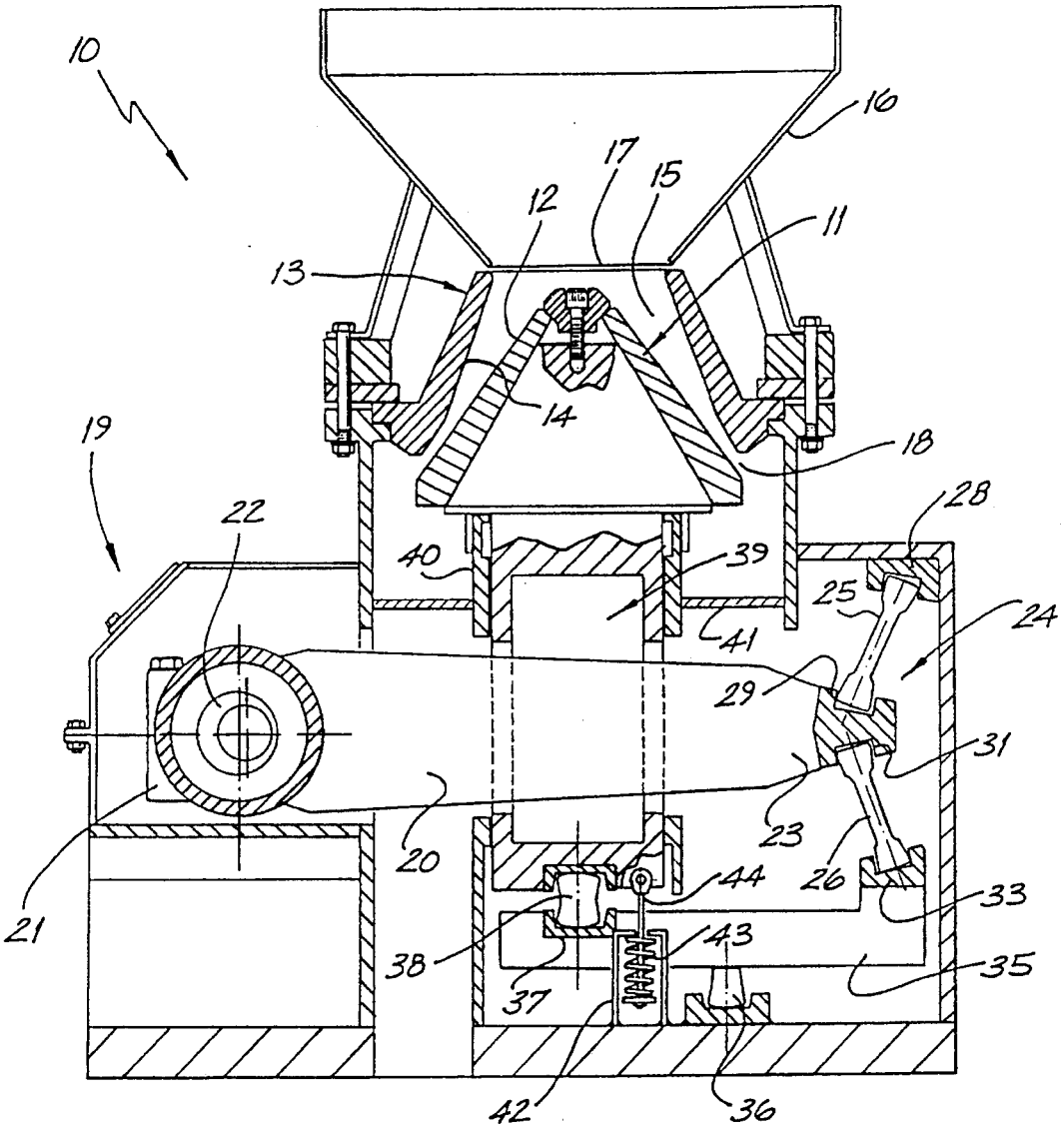
10
16
17
15
12
11
13
14
18
19
22
28
40
39
25
24
41
29
31
23
20
26
44
33
21
38
43
35
37
42
36

CRUSHER

TECHNICAL FIELD

The present invention relates to crushers.

BACKGROUND OF THE INVENTION

Known crushers such as that disclosed in Australian patent specification No. 67577/74, the disclosure of which is herein incorporated, have consisted of a first crusher member, which is of a conical configuration and which is caused to vertically reciprocate. Surrounding the first crusher member is a fixed crusher member, which has an internal surface of frusto-conical configuration. The first crusher member co-operates with the frusto-conical surface to provide a converging path along which the material to be crushed passes to be reduced in size.

The above discussed known crushers have the disadvantage of requiring considerable height due to the drive arrangement for the first crusher member.

OBJECT OF THE INVENTION

It is the object of the present invention to overcome or substantially ameliorate the above disadvantage.

SUMMARY OF THE INVENTION

There is disclosed herein a crusher comprising;

a fixed crusher member having an internal fixed crushing surface of frusto-conical configuration tapering upwardly;

a movable crusher member having an external surface of frusto-conical configuration tapering upwardly and being arranged with respect to the movable surface to define a downwardly converging space through which material to be crushed passes;

motor means to cause longitudinal vertical reciprocation of the movable crusher member relative to a fixed crusher member, said motor means including a driven member pivotably mounted for osciallation about a generally horizontal axis and a first coupling extending between said driven member and said movable crusher member to cause said vertical reciprocation thereof.

Preferably the motor means includes a drive beam arranged for horizontal reciprocation and a second coupling extending between the drive and driven members to cause angular oscillation of the driven member on horizontal oscillation of the drive member.

More preferably the drive member is eccentrically mounted on a rotating shaft so as to cause said horizontal reciprocation of the drive member on rotation of the shaft.

More preferably the shaft is on one transverse side of the movable crusher member and the second coupling is on the other transverse side.

Alternatively the drive member is located to one side of the movable crusher member.

DETAILED DESCRIPTION OF THE DRAWING

In the accompanying drawing there is schematically depicted in sectioned side elevation, a crusher according to an embodiment of the invention.

DETAILED DESCRIPTION OF THE PREFERRED EMBODIMENT

In the accompanying drawing there is schematically depicted a crusher 10 to reduce the size of material to be crushed. The crusher 10 includes a vertically movable crusher member 11 having an outer frusto-conical surface 12 which tapers vertically. Surrounding the member 11 is a fixed crusher member 13 having an internal crusher surface 14 also of a frusto-conical surface. The surface 12 and 14 co-operate to define a downwardly reducing space 15 into which material to be crushed is fed. As the material passes down the space 15 it is reduced in size due to the vertical reciprocation of the crusher member 11.

Mounted above the member 13 is a hopper 16 into which the material is delivered to be fed to the space 15.

The space 15 has an open top face 17, and an outlet face 18 which is of circular configuration. The face 18 permits the crushed material to leave the space 15.

The movable crusher member 11 is caused to reciprocate vertically by means of a motor assembly 19. The motor assembly 19 includes a drive beam 20 which is caused to horizontally reciprocate. More particularly, the end 21 of the beam 20, has an eccentric drive mechanism 22 which upon rotation causes the horizontal reciprocation of the beam 20 as well as some angular oscillation.

The other end 23 of the beam 20 engages a toggle mechanism 24. The toggle mechanism is similar to that of Patent Specification No. 67577/74. However by placing the toggle mechanism to one side of the crusher, rather than underneath, the overall height of the crusher is reduced. The toggle mechanism 24 includes a pair of linkages 25 and 26 which are caused to angularly oscillate about horizontal axes due to the horizontal reciprocation of the beam 20. More particularly, the upper end of the link 25 engages in a fixed socket 28. The lower end of the link 25 engages within a socket 29 located on the beam 20. Since the upper end of the link 25 cannot move vertically, this causes the beam 20 to rotate downwards as it moves towards the right. A second link 26 has an upper end engaged in a socket 31 on the beam 20 and a lower end engaged in a socket 33. The socket 33 is mounted on a driven beam 35 which is constrained to pivot about a horizontal transverse axis. Thus the socket 33 is constrained to follow an arc which is substantially vertical through its allowed movement. As the beam 20 moves rightwards the lower end of the link 26 is caused to move downwards relative to the socket 31. The socket 31 and beam 35 are thus caused to rotate clockwise.

The driven beam 35 is supported adjacent its centre about a pivot assembly 36. It will be appreciated that the pivot point need not be at the centre of the beam.

A socket 37 is provided in the beam 35, which socket 37 engages a link 38 engaging a coupling member 39 fixed to the movable crusher member 11.

The coupling member 39 is slidably guided by means of a guide assembly 40, so as to be restrained to reciprocate vertically. The beam 20 passes through an aperture formed in the guide assembly 40 and the link 39. Since the socket 37 on driven beam 35 moves along a substantially vertical path there is little sideways force exerted on the coupling member 39, thereby reducing wear.

Material crushed and leaving the face 18, passes on either side of the shield 41 protecting the drive assembly 19 below.

Tensioning the drive assembly 19, is a spring mechanism 41 including a bracket 42 against which there bears a spring 43. The spring 43 acts upon a link 44 extending to the coupling member 39 and draws the coupling member 39 downwards.

In operation the above described crusher 10, operating of the eccentric drive 22 causes horizontal reciprocation of the beam 20. This in turn via the toggle mechanism 24 causes angular oscillation of the beam 35. The beam 35 then causes vertical reciprocation of the movable crusher member 11. So as to achieve even wear of the two crusher members 13 and 11, preferably the lower crusher member 11 may rotate about a vertical axis relative to the upper crusher member 13. Where the drive beam 20 passes through the coupling 39, the lower crusher member 13 may be rotatably mounted on the coupling 39. Alternatively where the drive beam 20 does not pass through the coupling 39, the coupling 39 and the lower crusher member may be fixed together and rotate relative to the housing.

It will be appreciated that use of the toggle mechanism or eccentric drive is merely preferred and not essential to the working of the invention. Similarly placing the eccentric drive and toggle mechanisms on either side of the crusher is not essential. Obviously placing the eccentric drive adjacent the toggle mechanism is possible, in which case the drive beam 20 would not be required to pass through the crusher. It will be further appreciated that the size of the crushing space 15 may be varied either by moving the upper crusher member 13, by way of shims or hydraulic rams, or by moving the lower crusher member 11. Movement of the lower crusher member 11 may be achieved by altering the vertical position of the pivot assembly 36. More specifically the pivot assembly may be vertically movable by way of a hydraulic ram or by way of shims.

It will be appreciated that all of the sockets will preferably have hard wearing inserts so as to reduce wear. Similarly the profile of the ends of the links 25 and 26 is preferably such that they roll rather than skid across the respective socket surfaces.

It will be appreciated that many modifications and variations may be made to the embodiment described herein without departing from the spirit or scope of the invention.

I claim:

1. A crusher comprising:

a fixed crusher member having an internal fixed crushing surface of frusto-conical configuration tapering upwardly;

a movable crusher member having an external surface of frusto-conical configuration tapering upwardly and being arranged with respect to the movable surface to define a downwardly converging space through which material to be crushed passes;

motor means to cause longitudinal vertical reciprocation of the movable crusher member relative to the fixed crusher member, said motor means including a drive member arranged for horizontal reciprocation, a driven member pivotably mounted for oscillation about a generally horizontal axis, a first coupling operatively connecting said driven member and said movable crusher member to cause said vertical reciprocation thereof, and a second coupling operatively connecting the drive member and driven member to cause angular oscillation of the driven member on horizontal oscillation of the drive member.

2. The crusher of claim 1 wherein the drive member is eccentrically mounted on a rotatable shaft to cause horizontal reciprocation of the drive member on rotation thereof.

3. The crusher of claim 2 wherein the shaft is on one transverse side of the movable crusher member and the second coupling is on the other transverse side.

4. The crusher of claim 3, wherein the movable crusher member has a horizontally extending aperture passing therethrough and the drive member extends through the aperture.

5. The crusher of claim 1 wherein the drive member is located to one side of the movable crusher member.

6. The crusher of claim 5 wherein the horizontal axis is vertically movable relative to the fixed crusher member to vary the size of the downwardly converging space.

7. The crusher of claim 6 wherein there is provided an adjusting member for varying the vertical position of the horizontal axis.

8. The crusher of claim 7 wherein the lower crusher member is rotatable about a vertical axis relative to the upper crusher.

9. The crusher of claim 1, wherein said second coupling includes a toggle means which includes a first toggle element pivotally connected between said drive member and said driven member, a second toggle element pivotally connected to a housing section of the crusher and to said drive member, said toggle elements extending on opposite sides of said drive member and said drive member producing a linear displacement of said first toggle element at right angles to the direction of movement of said drive means.

* * * * *